US009101208B2

(12) United States Patent
LaMontagne et al.

(10) Patent No.: US 9,101,208 B2
(45) Date of Patent: Aug. 11, 2015

(54) SELF CLEANING REFRIGERATED DISPLAY CASE

(71) Applicant: Hussmann Corporation, Bridgeton, MO (US)

(72) Inventors: Rick M. LaMontagne, Warrenton, MO (US); Cherrie Bommarito, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 273 days.

(21) Appl. No.: 13/840,550

(22) Filed: Mar. 15, 2013

(65) Prior Publication Data

US 2014/0263739 A1 Sep. 18, 2014

(51) Int. Cl.

| | |
|---|---|
| ***B05B 17/08*** | (2006.01) |
| ***E03B 9/20*** | (2006.01) |
| ***A47B 3/04*** | (2006.01) |
| ***A47F 3/04*** | (2006.01) |

(52) U.S. Cl.

CPC ..... *A47B 3/04* (2013.01); *A47F 3/0482* (2013.01); *Y10T 29/49826* (2015.01)

(58) Field of Classification Search

CPC ..... B05B 17/08; B05B 7/1686
USPC ..... 239/302, 338, 136, 16, 17
See application file for complete search history.

(56) References Cited

U.S. PATENT DOCUMENTS

| | | | | |
|---|---|---|---|---|
| 2,625,806 | A | 1/1953 | Kennedy | |
| 3,347,145 | A | 10/1967 | Steelman | |
| 3,903,909 | A | 9/1975 | Noren et al. | |
| 4,038,103 | A | 7/1977 | Grunewald | |
| 4,315,414 | A | 2/1982 | Ibrahim | |
| 4,416,120 | A | 11/1983 | Yono et al. | |
| 5,173,258 | A | 12/1992 | Childers | |
| 5,195,334 | A | 3/1993 | Lang et al. | |
| 5,345,778 | A | 9/1994 | Roberts | |
| 5,408,834 | A | 4/1995 | Schlosser et al. | |
| 6,619,051 | B1 | 9/2003 | Kilawee et al. | |
| 7,051,545 | B2 | 5/2006 | Sauter | |
| 7,246,626 | B2 | 7/2007 | Fife et al. | |
| 7,334,416 | B2 | 2/2008 | Sauter | |
| 7,640,766 | B2 | 1/2010 | Shelton | |
| 2003/0201335 | A1 * | 10/2003 | Brown et al. | 239/17 |
| 2004/0020999 | A1 * | 2/2004 | Beidokhti | 239/17 |
| 2007/0138314 | A1 * | 6/2007 | Weemhoff | 239/16 |

OTHER PUBLICATIONS

Patent Examination Report No. 1 from IP Australia for Application No. 2013204079 dated Mar. 10, 2015 (5 pages).

* cited by examiner

*Primary Examiner* — Davis Hwu
(74) *Attorney, Agent, or Firm* — Michael Best & Friedrich LLP

(57) ABSTRACT

A merchandiser includes a base and a rear wall component extending above the base. The rear wall component includes a protruding rib. Foam insulation material is disposed in the protruding rib. The rear wall component has a first wall panel and a second wall panel spaced from the first wall panel. The first and second wall panel cooperatively define an air passageway configured for containing an evaporator. The base and second wall panel at least partially define a product display area. A spray nozzle is disposed within the air passageway and configured to spray fluid onto the evaporator. A portion of tubing fluidly couples the spray nozzle to a supply of water. The portion of tubing is disposed within the foam insulation material.

19 Claims, 17 Drawing Sheets

SELF CLEANING REFRIGERATED DISPLAY CASE

BACKGROUND

The present invention relates to merchandisers, and more particularly to merchandisers including a uni-body structure and a self-cleaning system.

Merchandisers generally include a case defining a product display area for supporting and displaying food products to be visible and accessible through an opening in the front of the case. Merchandisers are generally used in retail food store applications such as grocery or convenient stores or other locations where food product is displayed in a refrigerated condition. Some merchandisers include doors to enclose the product display area of the case and reduce the amount of cold air released into the surrounding environment. The doors typically include one or more glass panels that allow a consumer to view the food products stored inside the case. Other merchandisers do not have doors, but utilize one or more air curtains directed across the product display area to separate the refrigerated environment of the product display area from the ambient environment surrounding the merchandiser.

Existing merchandisers utilize heavy gauge, structural steel external frames to carry structural load, including the weight of food product within the merchandisers and the weight of repair technicians standing on top of the merchandisers during installation or repair. Existing merchandisers also include one or more foam insulation panels disposed within the external frames. The foam insulation panels consist of sheet metal skins surrounding a layer of blown polyurethane insulation. The sheet metal skins provide an attachment surface for merchandiser components. The skins also provide a moisture barrier to prevent moisture from migrating into the polyurethane foam insulation and degrading the insulation properties of the foam. However, the sheet metal skins and foam in existing merchandisers cannot carry structural load.

SUMMARY

In one construction, a merchandiser includes a base and a rear wall component extending above the base. The rear wall component includes a protruding rib. Foam insulation material is disposed in the protruding rib. The rear wall component has a first wall panel and a second wall panel spaced from the first wall panel. The first and second wall panel cooperatively define an air passageway configured for containing an evaporator. The base and second wall panel at least partially define a product display area. A spray nozzle is disposed within the air passageway and configured to spray fluid onto the evaporator. A portion of tubing fluidly couples the spray nozzle to a supply of water. The portion of tubing is disposed within the foam insulation material.

In one construction, a merchandiser has a first side and a second side, and a base. The base includes a drain and a liner extending from the first side to the second side. A spray nozzle is disposed adjacent the liner and the first side and configured to direct a spray of fluid to the drain. A portion of tubing fluidly couples the spray nozzle to a supply of water. The portion of tubing is disposed within foam insulation material coupled to the base.

In one embodiment of a method of manufacturing a merchandiser having a base portion with a layer of insulating foam, the method includes securing a liner to the base portion and coupling a spray nozzle to the base portion adjacent the liner. The method also includes positioning a portion of tubing in fluid communication with the spray nozzle. The method further includes foaming in place the portion of tubing with the insulating foam.

Other aspects of the invention will become apparent by consideration of the detailed description and accompanying drawings.

DETAILED DESCRIPTION

Before any constructions of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
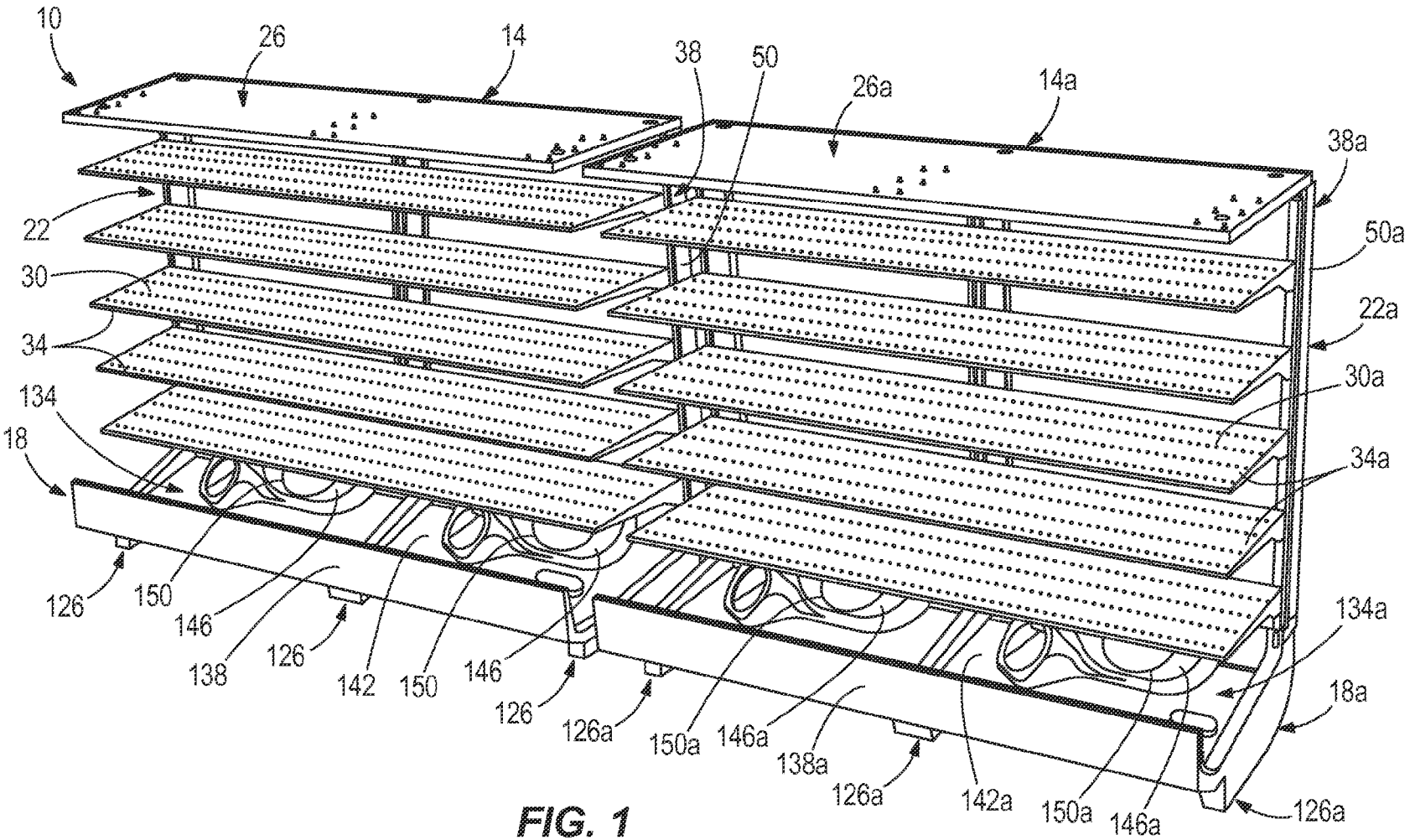
FIG. 1 is a front perspective view of a merchandiser embodying the present invention.
Figure 2:
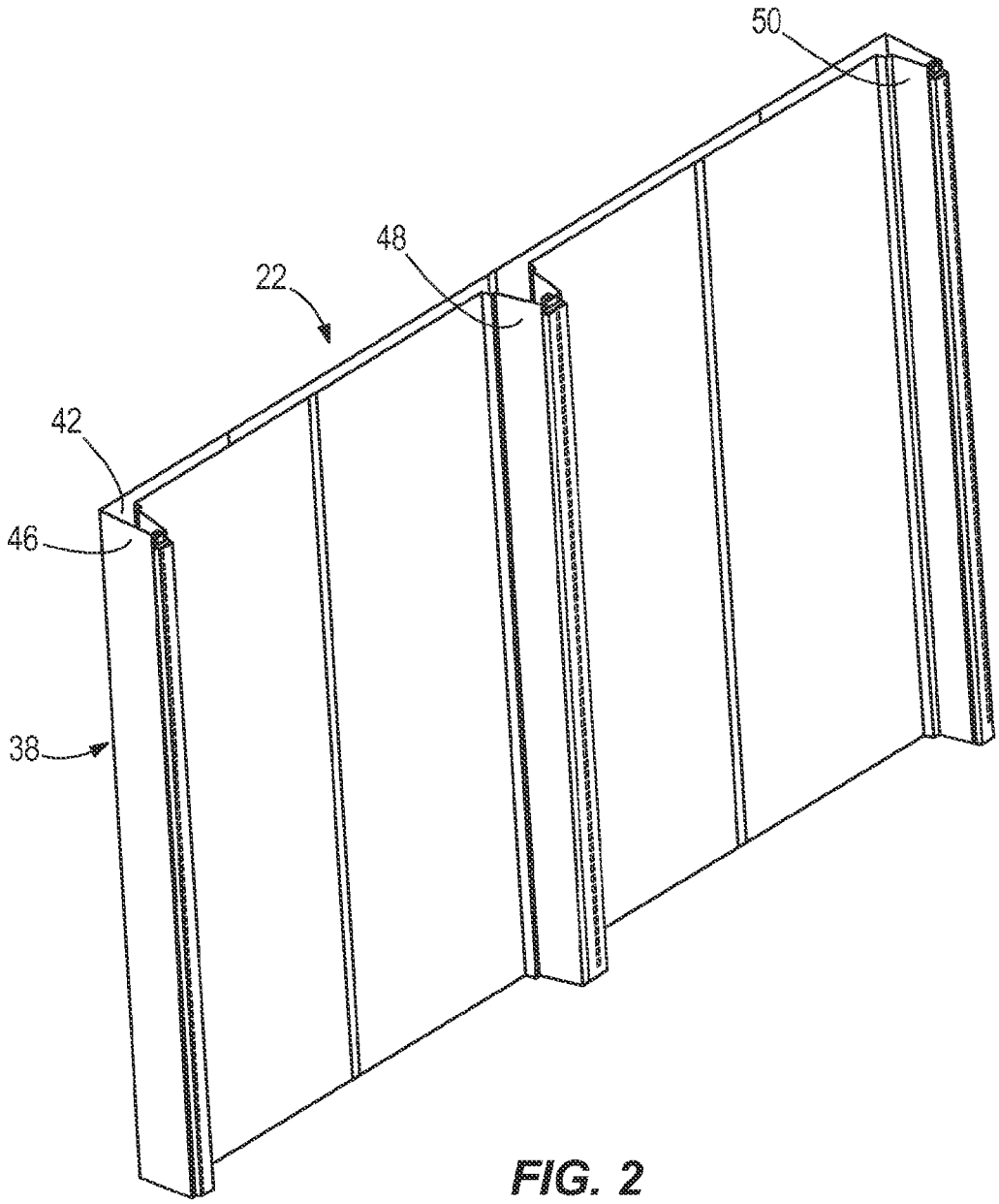
FIG. 2 is a front perspective view of a rear wall of the merchandiser of FIG. 1.

FIG. 1 shows a partially assembled merchandiser 10 that may be located in a supermarket or convenience store for presenting fresh food, beverages, and other food product (not shown) to consumers. The merchandiser 10 may be a refrigerated merchandiser 10 or a non-refrigerated merchandiser 10. The merchandiser 10 includes a case 14 that includes a base 18, a rear wall 22, and a canopy 26. The area partially enclosed by the base 18, rear wall 22, and canopy 26 defines a product display area 30 that supports food product in the case 14. The food product is displayed on racks or shelves 34 extending forwardly from the rear wall 22, and is accessible by consumers. The illustrated merchandiser 10 does not include doors providing access to the product display area 30, although the merchandiser 10 may include one or more doors to provide access to the product display area 30.

Referring to FIGS. 2-4 and 16, the rear wall 22 includes a rear wall component 38 that defines an open insulation channel 42 in which load-bearing foam insulation 44 is disposed. The load-bearing foam insulation 44 can be polyurethane foam or other types of load-bearing foam insulation are also possible. As will be appreciated by one of ordinary skill in the art, load-bearing foam insulation 44 fills the insulation channel 42 and binds to the rear wall component 38, thereby forming a sandwiched configuration. The rear wall component 38 and the insulation channel 42 extend in a generally vertical direction. The rear wall component 38 is a sheet metal skin, though in other constructions different material other than sheet metal is used. While the rear wall component 38 is illustrated as a single sheet metal skin extending around the insulation channel 42, in other constructions the rear wall component 38 is a plurality of sheet metal skins, or other material, coupled together to form the insulation channel 42.

Figure 3:
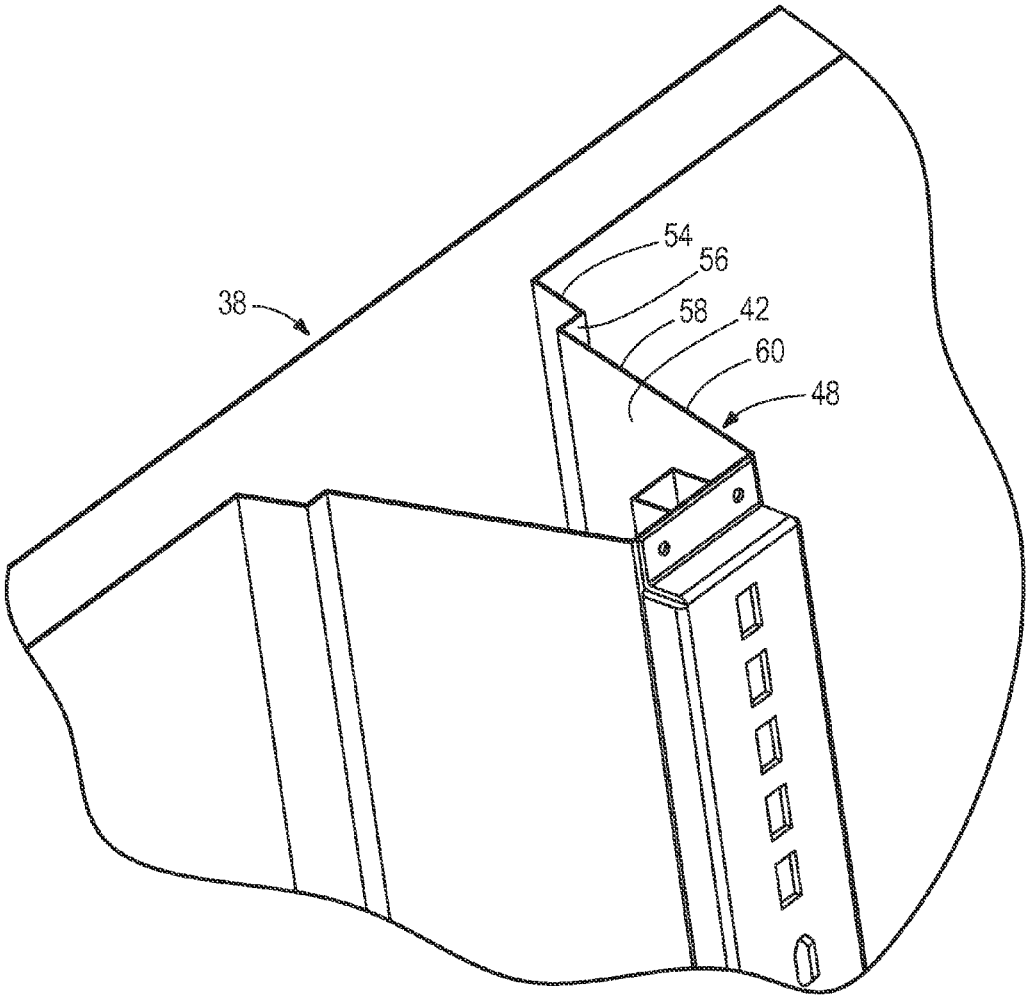
FIG. 3 is an enlarged front perspective view of an area of the rear wall of FIG. 2, illustrating a ribbed rear wall component of the rear wall.
Figure 4:
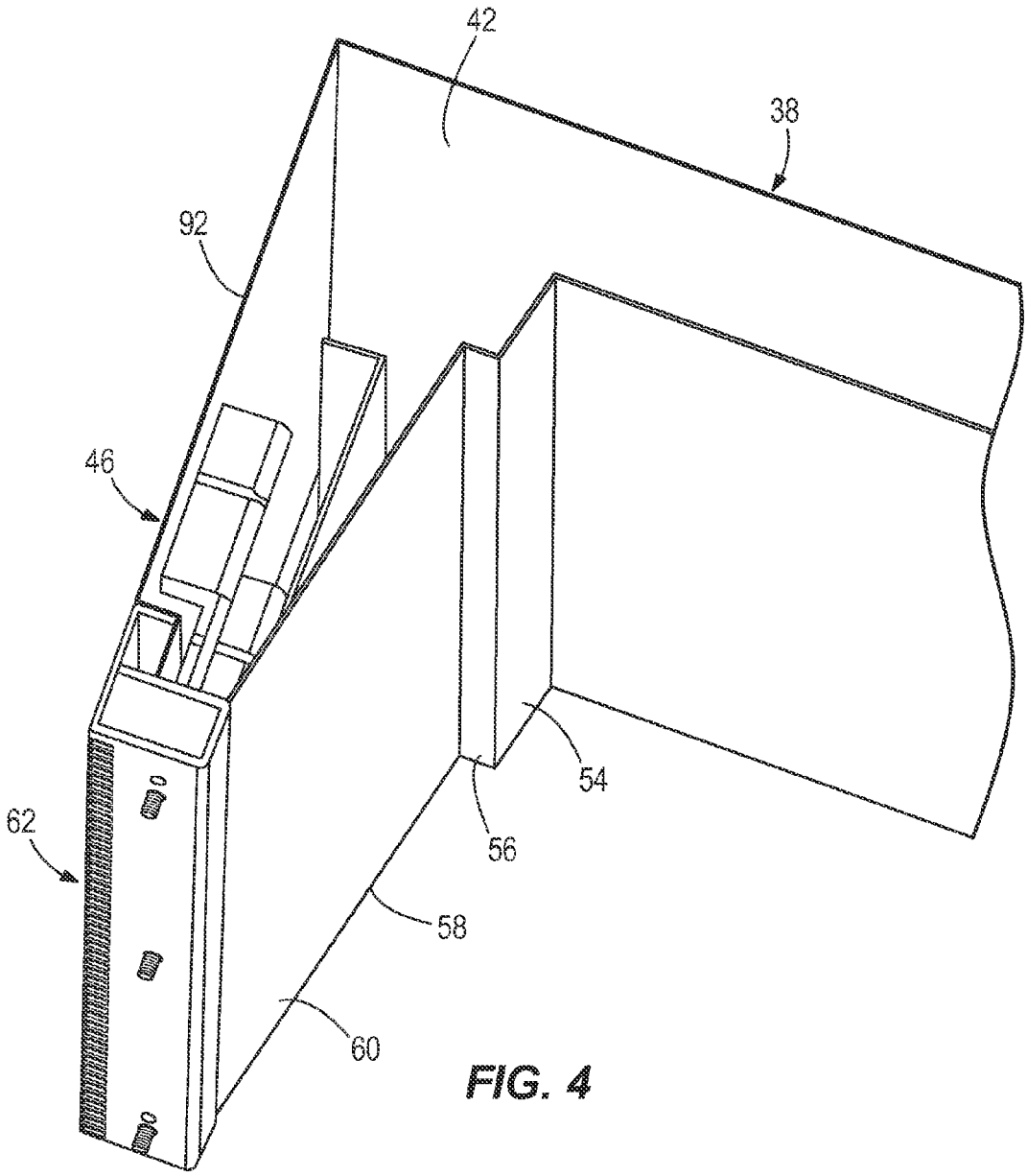
FIG. 4 is an enlarged front perspective view of another area of the rear wall of FIG. 2, illustrating the ribbed rear wall component.

The rear wall component 38 is a ribbed structure that has a plurality of elongate ribs 46, 48, 50 spaced along the rear wall component 38. The ribs 46, 48, 50 extend generally vertically between the canopy 26 and the base 18, and rear wall panels 52 extend horizontally between the ribs 46, 48 and the ribs 48, 50. The channel 42 is defined by the space enclosed by the ribs 46, 48, 50, the rear wall panels 52, and a back wall 53 of the rear all component 38. With reference to FIGS. 3 and 4, the ribs 46, 48, and 50 have a stepped or pyramidal shape when viewed in cross-section. As illustrated, the ribs 46, 48, 50 each have a first stepped portion 54 and a second stepped portion 58 formed by sheet metal roll forming equipment. The first stepped portion 54 includes a first planar portion 56, and the second stepped portion 58 includes a second, separate planar portion 60. The ribs 46, 48, 50 provide structural strength to the merchandiser 10, and in conjunction with the load-bearing foam insulation disposed in the insulation channel 42, provide enough strength to support structural loads, including loads from food product on shelves 34 or repair technicians standing on the merchandiser 10.

While the illustrated merchandiser 10 has three ribs 46, 48, 50 the merchandiser 10 can include fewer or more than three ribs depending in part on the size of the merchandiser. While the illustrated ribs 46, 48, and 50 are generally evenly spaced along the rear wall component 38 with two ribs 46, 50 positioned adjacent lateral ends of the rear wall component 38 and one rib 48 substantially centered on the rear wall component 38, the ribs 46, 48, 50 can have other spaced arrangements.

Figure 5:
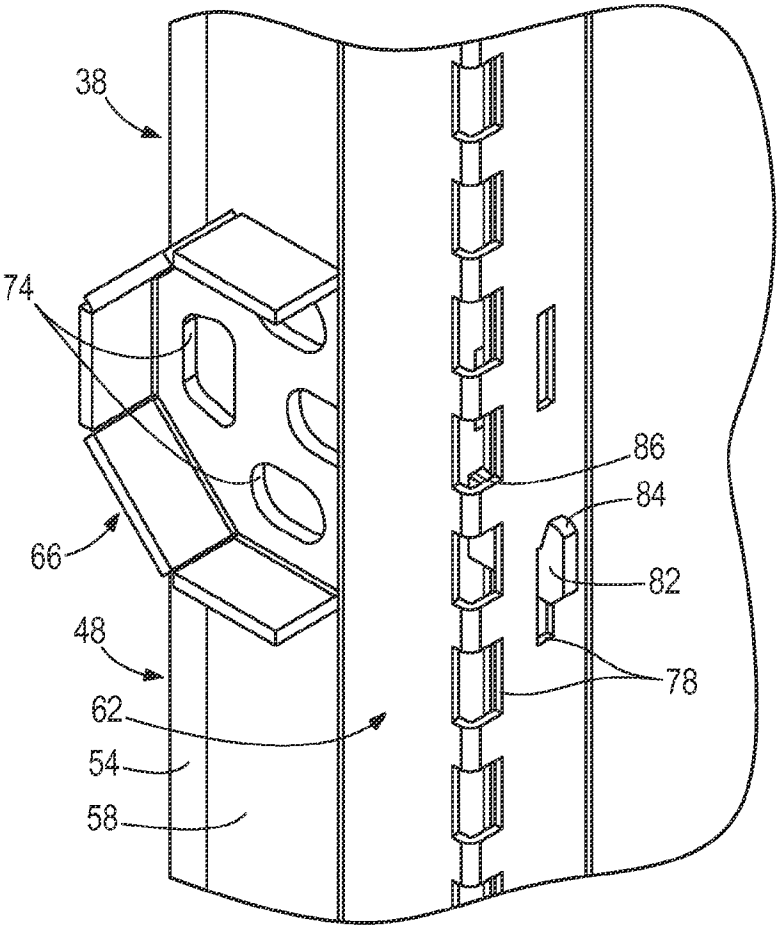
FIG. 5 is an enlarged front perspective view of a shelf standard locating bracket disposed in the rear wall of FIG. 2.

With reference to FIGS. 3-7, the merchandiser 10 includes shelf standards 62 and shelf standard locating brackets 66, 70. The shelf standard locating brackets 66, 70 are foamed in place within the insulation channel 42. The load-bearing foam insulation 44 encases the shelf standard locating brackets 66, 70 and binds the shelf standard locating brackets 66, 70 in a fixed position and orientation within the insulation channel 42. In some constructions, the shelf standard locating brackets 66, 70 are also fastened (e.g. with metal fasteners) to the rear wall component 38. As illustrated in FIG. 5, the shelf standard locating bracket 66 includes openings 74 to assist with foaming the bracket 66 in place. While the illustrated merchandiser 10 utilizes different-shaped shelf standard locating brackets, the brackets 66, 70 can be uniform.

Figure 6:
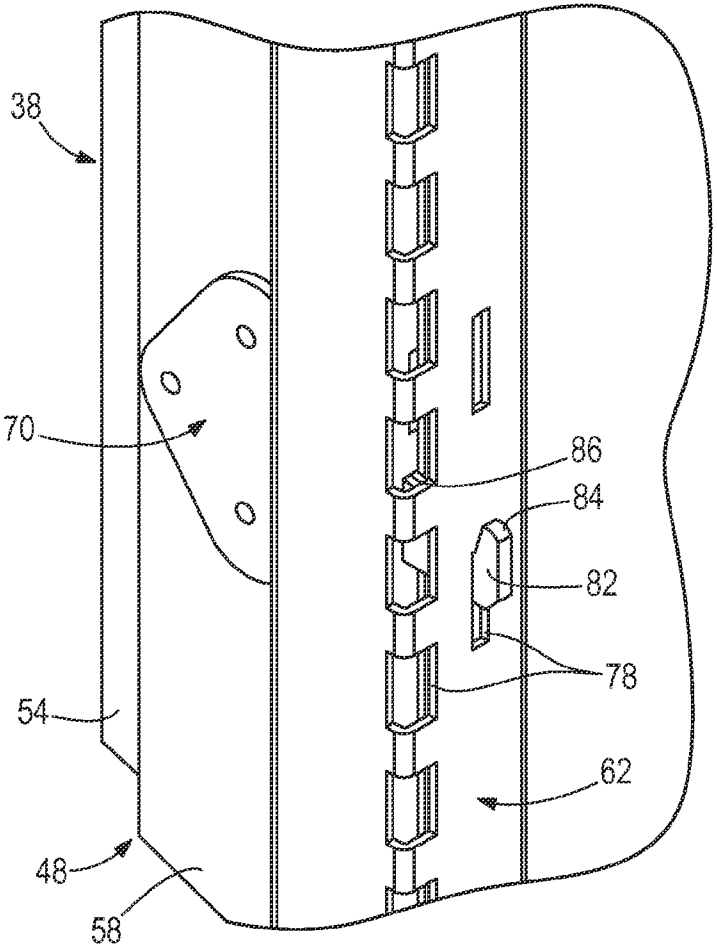
FIG. 6 is an enlarged front perspective view of another shelf standard locating bracket disposed in the rear wall of FIG. 2.

As illustrated in FIGS. 5 and 6, the shelf standards 62 are elongate metal or plastic or composite structures that include a plurality of openings 78 to support the shelves 34 in one of several vertical positions. The shelf standards 62 are disposed adjacent the ribs 46, 48, 50, and are disposed outside of the insulation channel 42.

The shelf standard locating brackets 66, 70 include extension arms 82 that have hooks 84 extending outward from the foam insulation channel 42 to align and support the shelf standards 62 in the merchandiser 10. As shown in FIGS. 5 and 6, the extension arms 82 extend through the openings 78 such that the shelf standards 62 are supported or rest on the extension arms 82 of the brackets 66, 70.

Figure 8:
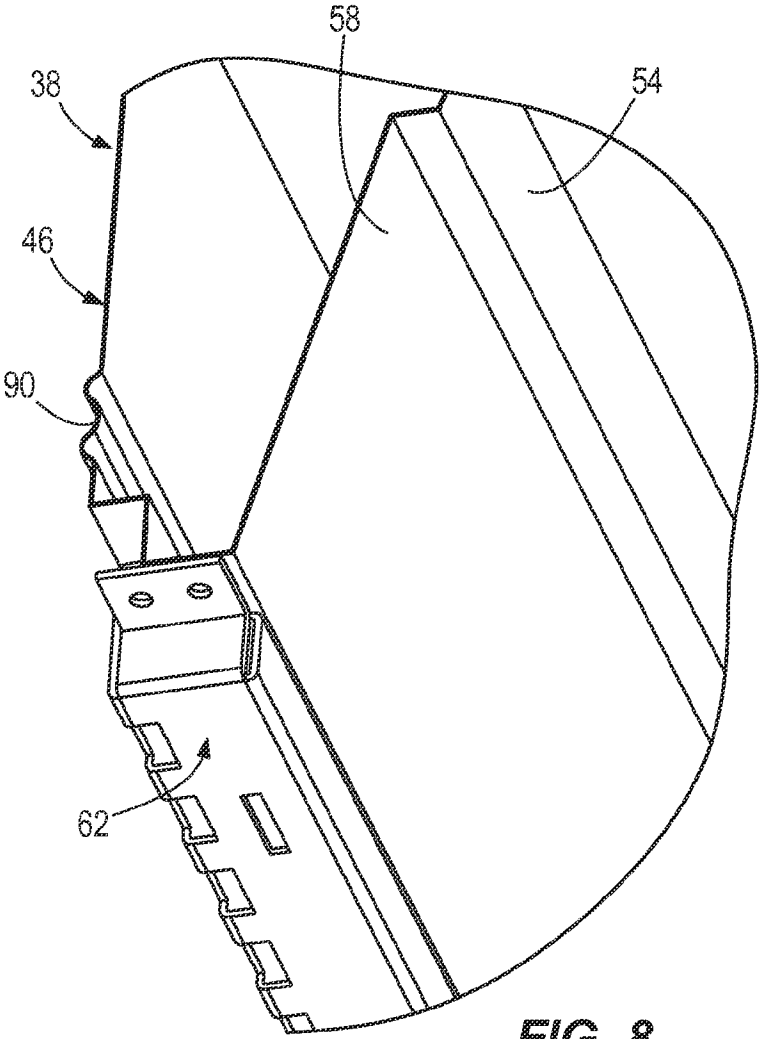
FIG. 8 is an enlarged front perspective view of the area of FIG. 7, illustrating the sealing gasket channel in further detail.
Figure 7:
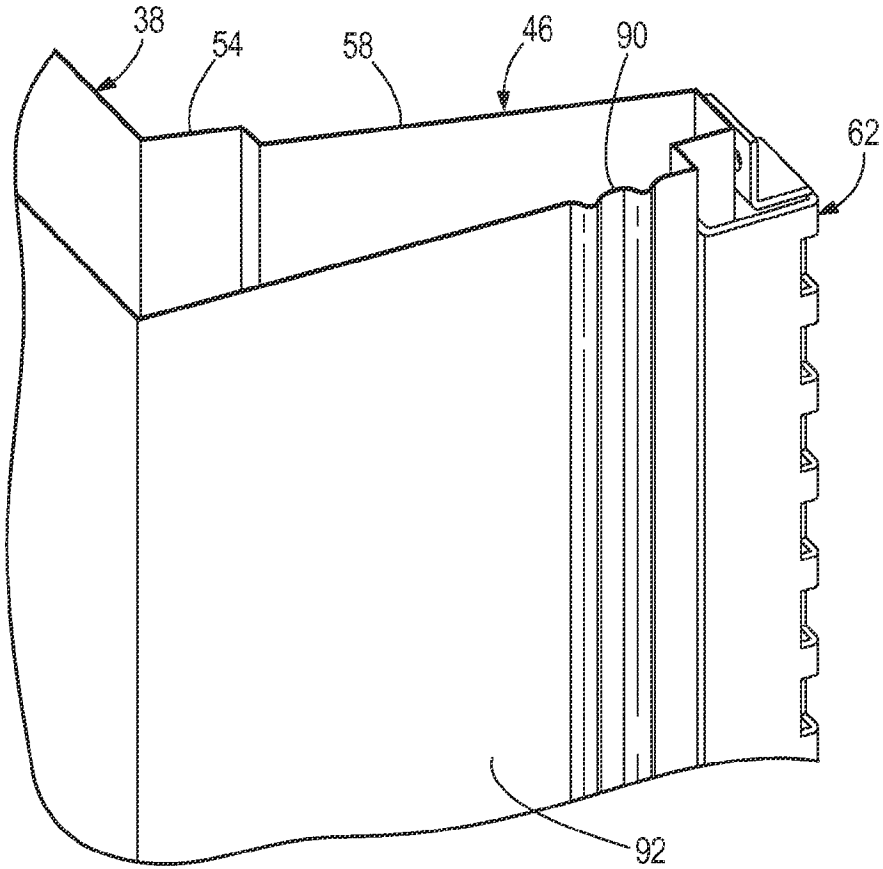
FIG. 7 is an enlarged back perspective view of an area of the rear wall of FIG. 2, illustrating a sealing gasket channel along the rear wall component.
Figure 9:
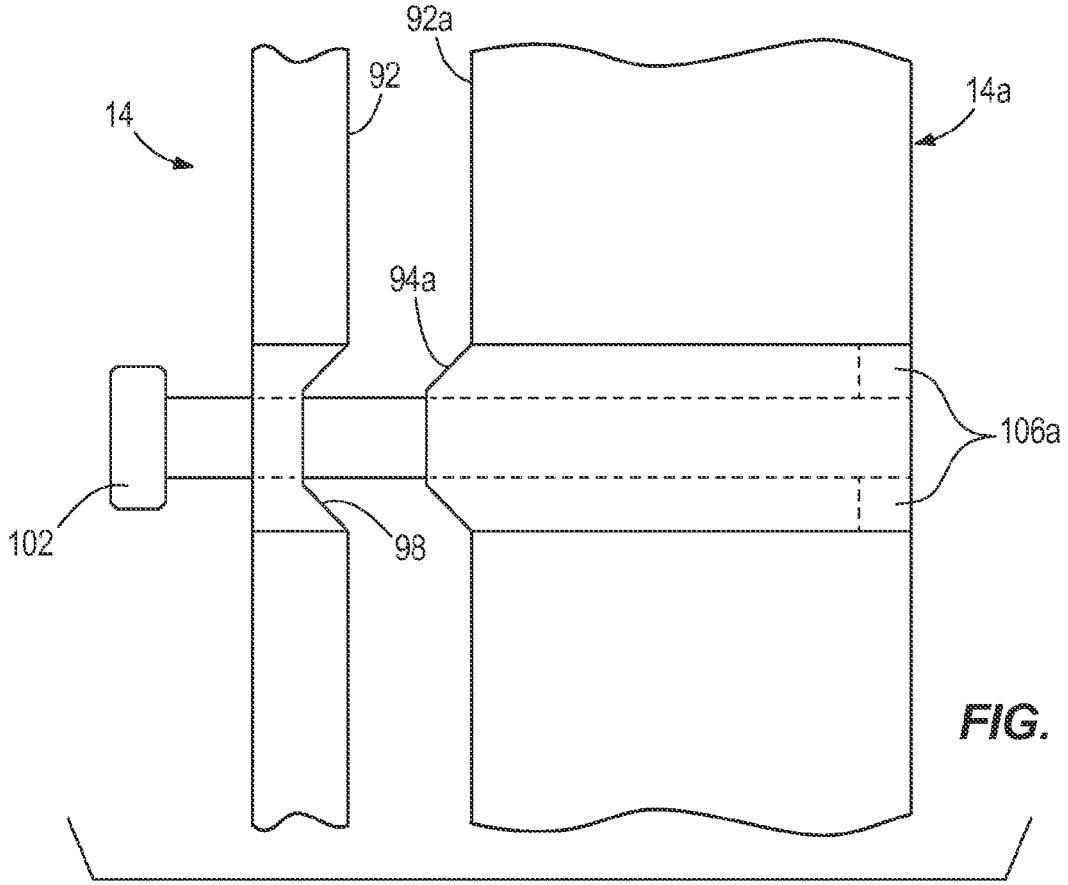
FIG. 9 is a schematic illustration of a portion of two merchandisers, and components for joining the two merchandisers.

With reference to FIGS. 7-9, the rear wall component 38 defines an elongate gasket channel 90 extending vertically along the outermost ribs 46, 50 (one shown). The gasket channel 90 is shaped and sized to receive a gasket to facilitate sealing engagement between the case 14 and another case **14*a* (see e.g. FIG. 9) positioned alongside the case 14 to prevent infiltration of water or other debris between the cases 14, 14*a* and to provide a seamless connection between the cases 14, 14*a*. The two cases 14, 14*a* can be from separate merchandisers, or sections of the same merchandiser 10. The gasket channel 90 is formed by sheet metal roll forming equipment. While a single channel 90 is illustrated, the merchandiser 10 can include a two or more gasket channels 90** and associated gaskets.

Figure 13:
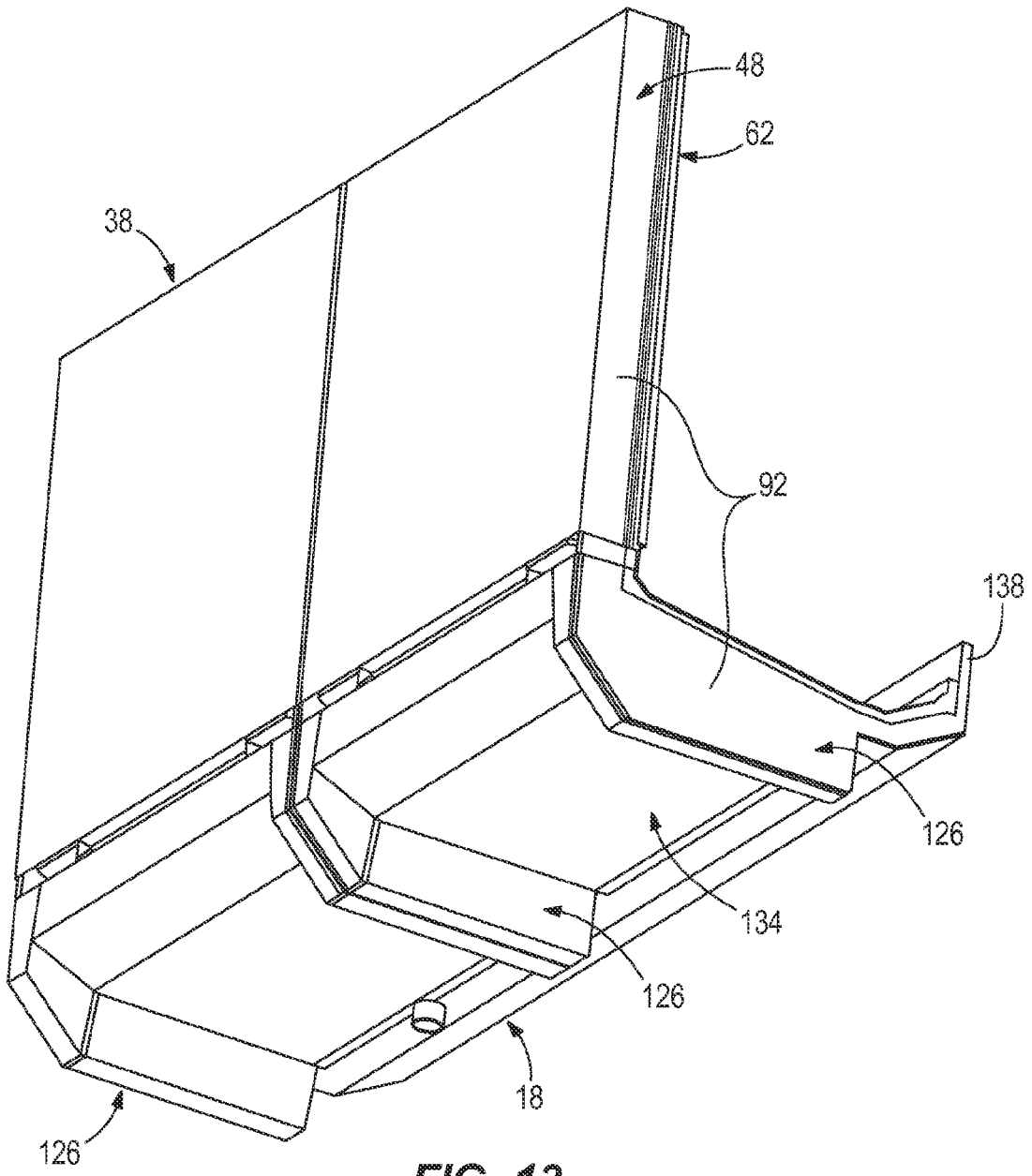
FIG. 13 is a back perspective view of the rear wall, the plurality of leg components, and a base component of the merchandiser of FIG. 1.
Figure 16:
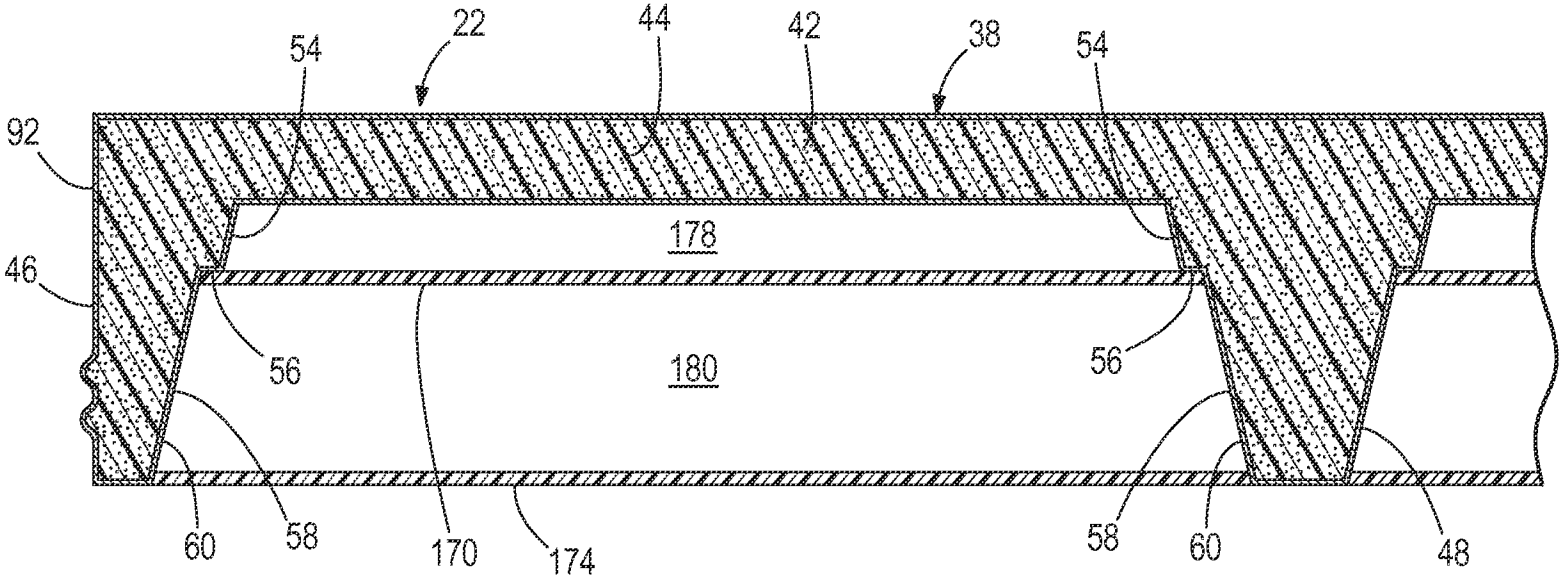
FIG. 16 is a schematic cross-sectional view of the merchandiser of FIG. 1, illustrating rear wall panels and air passageways.

With reference to FIGS. 9, 13, and 16, lateral sides of the base 18 and the rear wall 22 define planar lateral ends 92 for each case 14, **14*a*. Each planar end 92 is matable with a planar end 92 of another case. For example, as shown in FIG. 9, the planar end 92 of the case 14 is mated with the planar end of the case 14*a*. The planar ends 92 are disposed on exterior sides of the cases 14, 14*a* and define lateral mating surfaces. One or both of the planar ends 92 of each case 14, 14*a* can include the gasket channels 90** described above.

As illustrated in FIG. 9, each planar end 92 has one of a male mating component 94 and a female mating component 98 that is matable with a complementary mating component 94, 98 on the case to which the case 14, **14*a* is attached. It is possible that each planar end 92 can have both male and female mating components 94, 98 arranged along the side(s) of the case that are matable with the complementary component located in a symmetrical position on the other case. With reference to FIG. 9, the male mating component 94 protrudes outward from the planar end 92 and is defined by a tapered pin integrally formed in the planar end 92, whereas the female mating component 98 is recessed in the planar end 92 to define a socket for a complementary male mating component 94. As will be appreciated, the male and female mating components 94, 98 assist with properly aligning adjacent cases with each other, and with the gasket, define a seamless connection between the cases (e.g., cases 14, 14***a*).

With continued reference to FIG. 9, the cases 14, 14*a* have holes 100 that extend through the planar ends 92 and that align with complementary holes 100 in the case to which the case 14, 14*a* will be attached. As illustrated, the holes 100 extend through the male and female mating components 94, 98, and an anti-spin joining bolt 102 extends through each hole 100. The bolt 102 extends through the planar ends 92 is secured to a bolt receiving portion 106 (e.g., a nut, etc.) to secure the adjoining cases (e.g., cases 14, 14*a*) to each other and slightly compress the gaskets in the channel 90 to seal the seam or joint between the cases 14, 14*a*.

Figure 10:
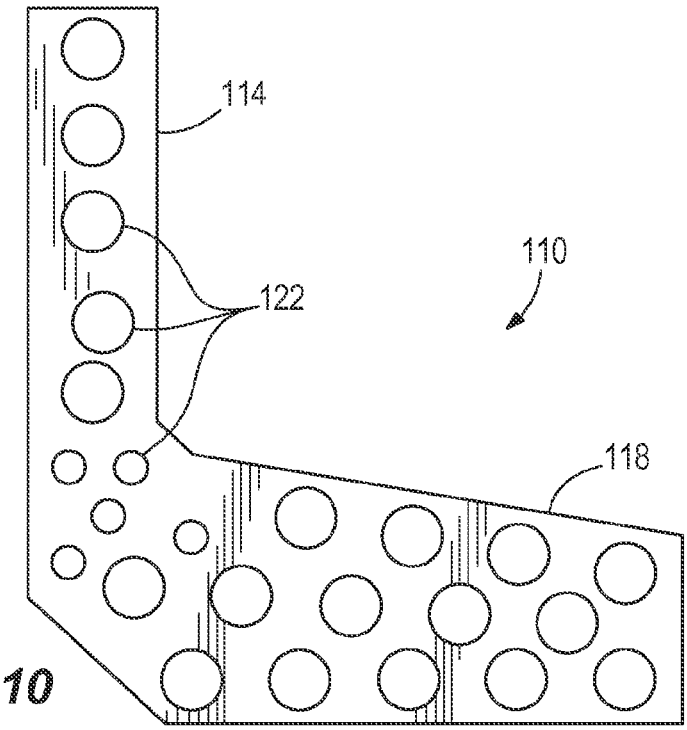
FIG. 10 is side view of a shoe component of the merchandiser of FIG. 1.
Figure 11:
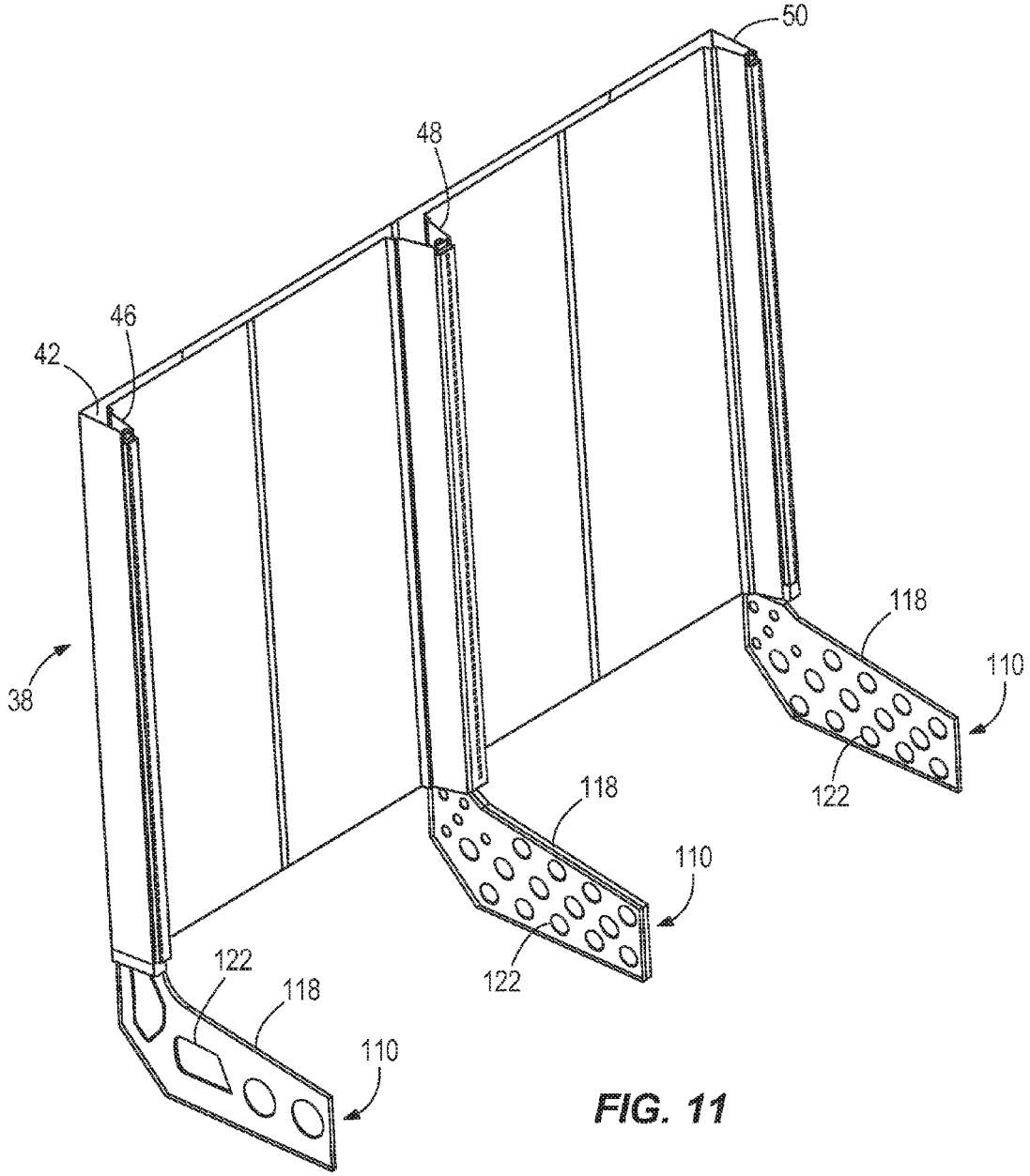
FIG. 11 is a front perspective view of a plurality of shoe components partially disposed within the rear wall of FIG. 2.
Figure 12:
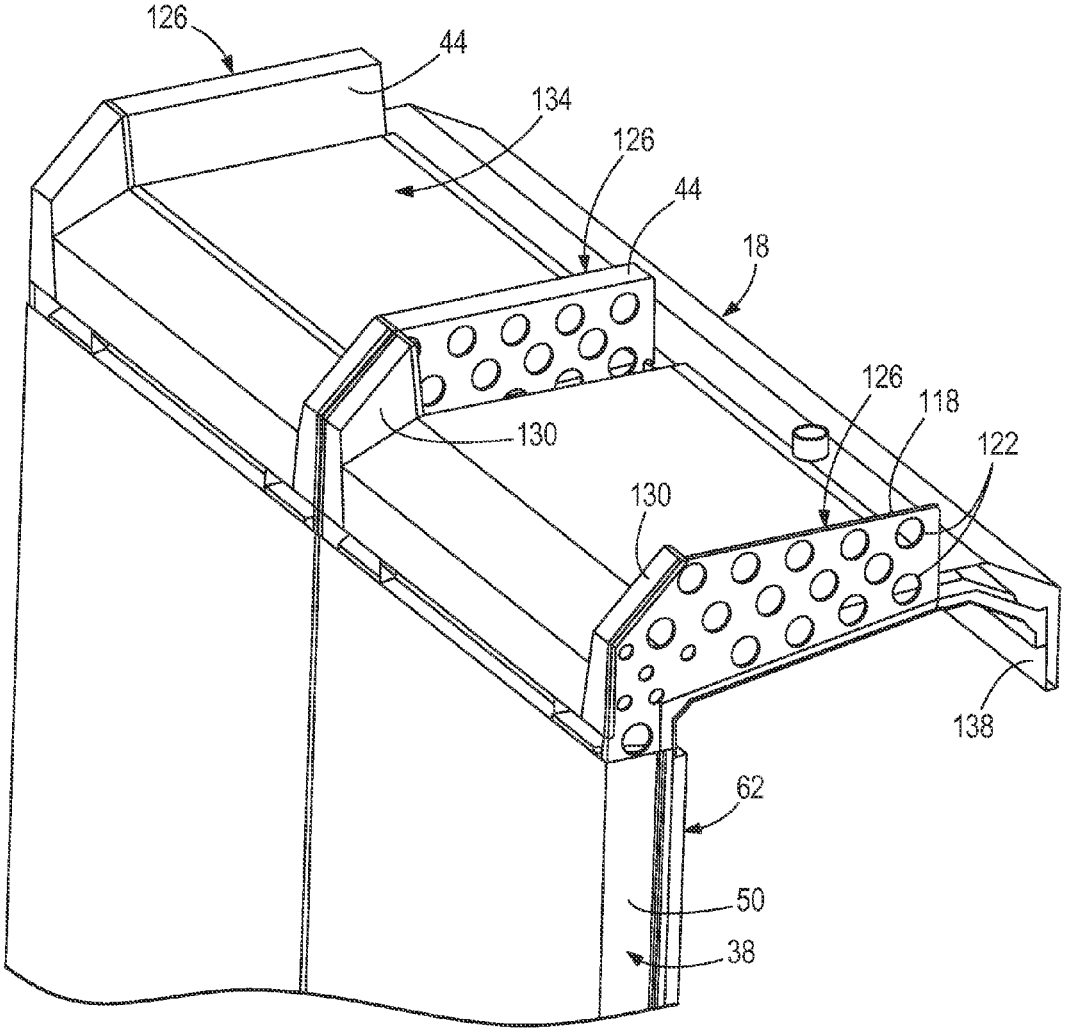
FIG. 12 is a back perspective view of the rear wall, a plurality of leg components, and a base component of the merchandiser of FIG. 1, two of the leg components only partially assembled.

With reference to FIGS. 10 and 11, the merchandiser 10 further includes shoes 110 that couple the base 18 with the rear wall component 22 and that support the base 18 on a surface (e.g., floor of a retail setting). The shoes 110 are formed of metal (e.g., aluminum, stainless steel, etc.) although other materials (e.g., composite material, elastomeric material, etc) can be used. As illustrated, each shoe 110 is L-shaped and includes a first shoe portion 114 and a second shoe portion 118. The shoes 110 are be made relatively light by forming the shoes 110 with openings 122 that are used to more securely foam the shoes in place within the case 14. The first shoe portions 114 extend into the insulation channel 42 in an area directly behind the ribs 46, 48, 50. The first shoe portions 114 are foamed in place with the load-bearing foam insulation 44 inside the insulation channel 42. The load-bearing foam insulation 44 encases the first shoe portions 114 and binds the shoes 110 in a fixed position and orientation. In some constructions the first shoe portions 114 are also fastened (e.g. with metal fasteners) to the rear wall component 38. While the merchandiser 10 includes three shoes 110, the merchandiser 10 can include fewer or more than three shoes 110, FIGS. 12 and 13 illustrate an underside of the base 18 including leg components 126. The leg components 126 include the second shoe portions 118. The leg components 126 include at least one layer of the load-bearing foam insulation 44 disposed adjacent the second shoe portions 118. The leg components 126 also include a layer of plastic material 130. The plastic material 130 surrounds at least a portion of the shoes 110. The leg components 126 support the merchandiser 10 on a floor surface (not shown) and provide stability and structural support to the merchandiser 10. In addition, the leg components 126 facilitate sliding the merchandiser 10 across the floor surface to reposition the merchandiser, if desired.

Figure 14:
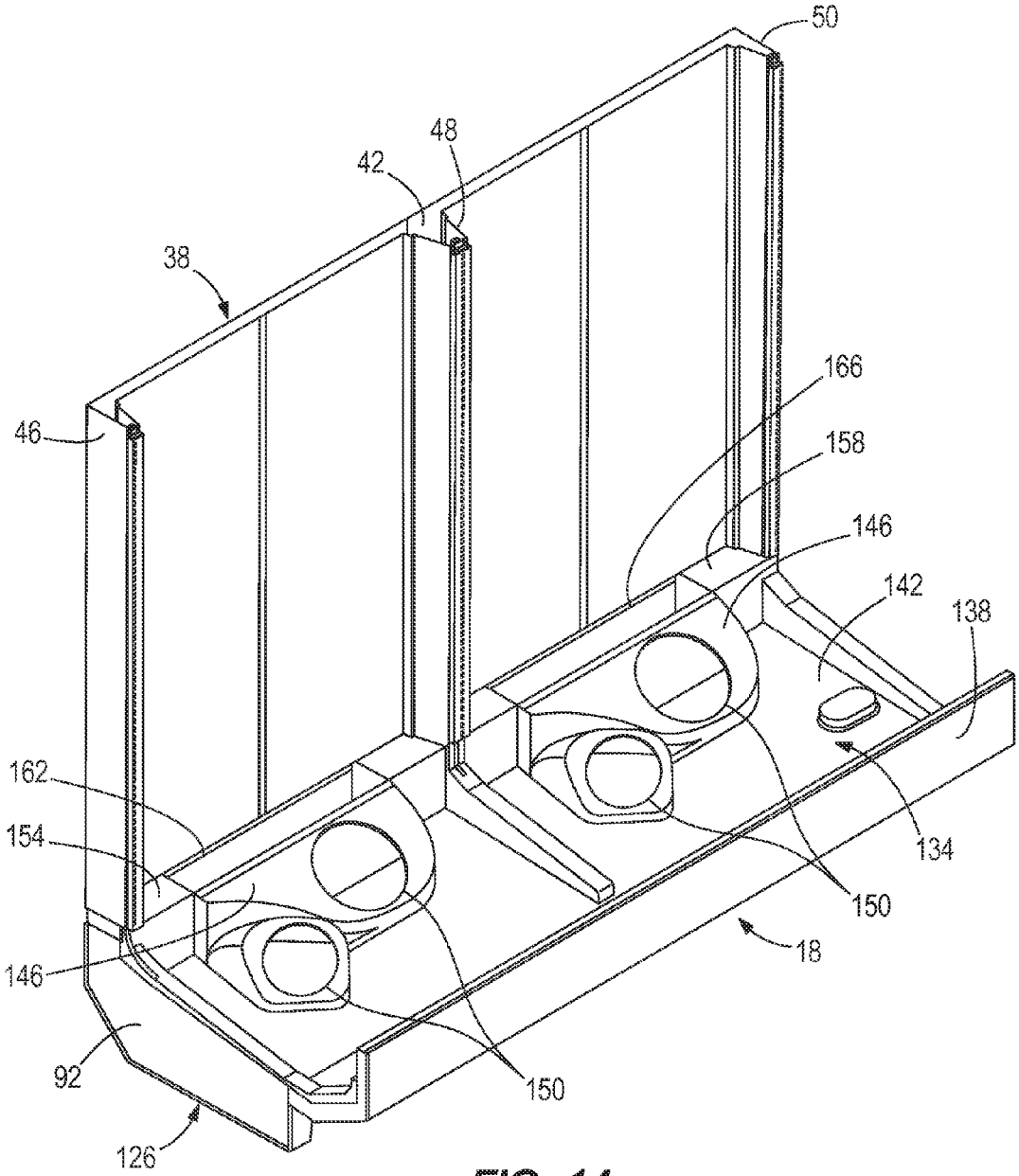
FIG. 14 is a front perspective view of the rear wall, the plurality leg components, and the base component of the merchandiser of FIG. 1, further illustrating a liner component disposed above the base component.

With reference to FIGS. 12-14, the base 18 further includes a base component 134 (e.g., formed of sheet metal) that is an outer liner encapsulating the load-bearing foam insulation 44. The base component 134 extends from the rear wall 22 has a generally U-shaped configuration when viewed from the side. The base component 134 includes a front rail 138 partially defining an air return for the merchandiser 10. The front rail 138 extends vertically and generally parallel to the rear wall 22.

Figure 15:
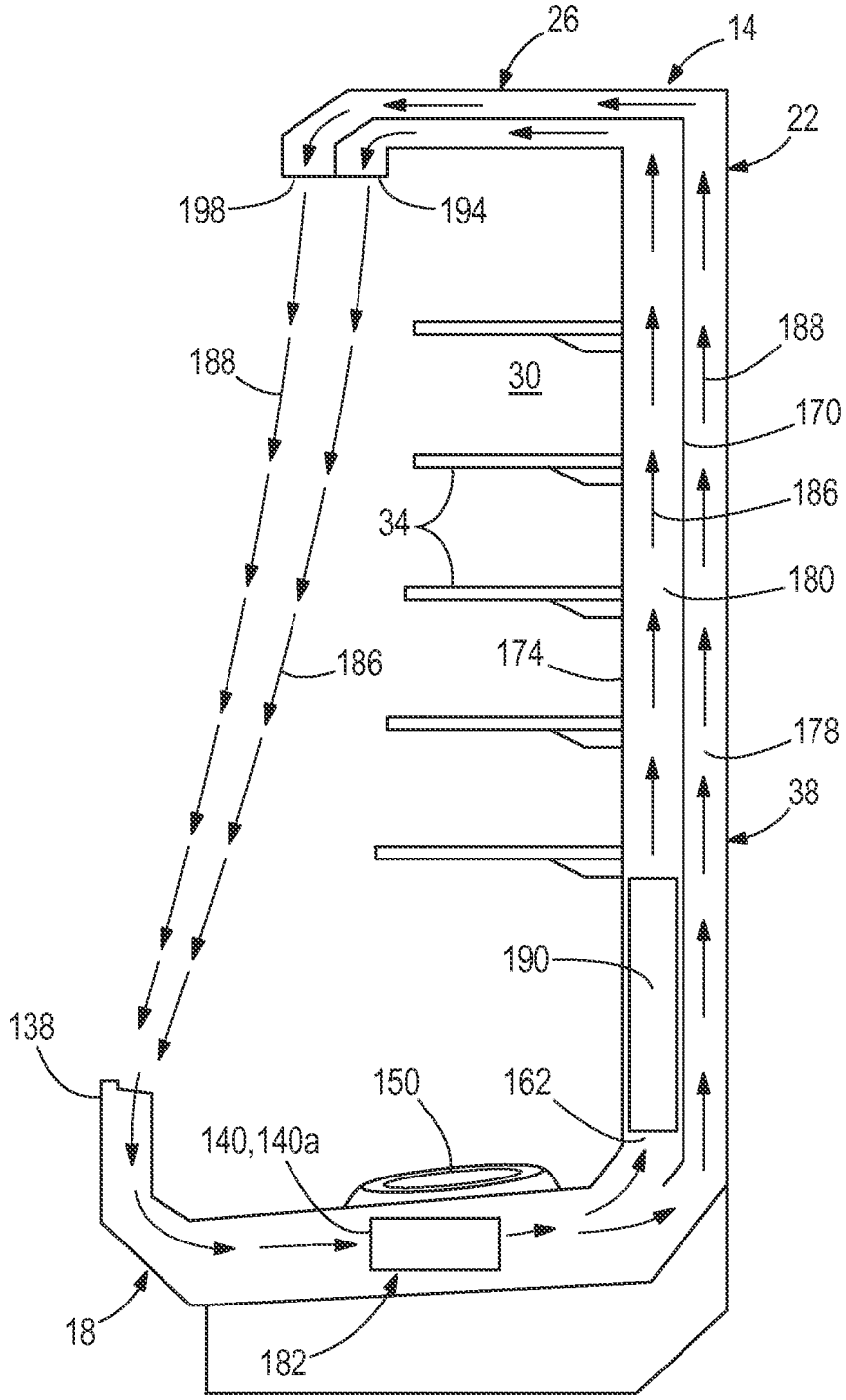
FIG. 15 is schematic cross-sectional view of the merchandiser of FIG. 1, further illustrating an evaporator coil disposed within the rear wall.

The base component 134 also partially defines an area adjacent the rear wall component 38 that supports first and second fans 140, 140*a* (see FIG. 15). A drain is disposed below a base pan (i.e. below the lowest shelf 34 in the merchandiser 10). The base component 134 has an interior floor 142. With reference to FIG. 14, the floor 142 supports a pivotable housing or liner 146 that partially covers or encloses the fan 140 and that provides access to the fan 140 or one or more other refrigeration components (e.g., refrigeration and electrical access pads, wire rack supports, display pan supports, case-to-case refrigeration piping supports, and plenum transition walls, etc.). The liner 146 defines a plurality of openings 150 through which the fans 140, 140*a* direct air through the base 18 and along the rear wall component 38 to the canopy 26. The liner 146 is pivotable about the base 18 from the closed position (illustrated in FIG. 14) to a raised position to provide access to the fans 140, 140*a*, and in some constructions, to other refrigeration components disposed in the case 14.

The base component 134 further includes two raised ledge portions 154, 158 extending horizontally along the rear wall 22. The raised ledge portions 154, 158 include flues 162, 166 located between the ribs 46 and 48 and between the ribs 48 and 50, respectively. The flues 162, 166 provide openings for air movement, as described in more detail below.

With reference to FIGS. 15 and 16, the merchandiser 10 includes first wall panels 170 and second wall panels 174 extending between the ribs 46, 48, and 50. Each first wall panel 170 is removably coupled to the first planar portions 56 of the ribs 46, 48, 50. As illustrated in FIG. 16, the first wall panels 170 and the rear wall panel 52 cooperatively define a first air passageway 178 that is in airflow communication with the fan 140*a*. The second wall panels 174 are removably coupled to the second planar portions 60 of the ribs 46, 48, 50. As shown in FIG. 16, the second wall panel 174 and the first wall panel 170 cooperatively define a second air passageway 180 (directly in front of the passageway 178—closer to the product display area 30) that is also in airflow communication with the fan 140.

With continued reference to FIG. 15, at least a portion of a refrigeration system 182 is in communication with the case 14 to provide a refrigerated airflow (denoted by arrows 186) to the product display area 30 through the second passageway 180 via the fan 140. A non-refrigerated airflow (denoted by arrows 188) moves through the first passageway 178 via the fan 140*a*. As will be appreciated by one of ordinary skill in the art, the first and second wall panels 170, 174 separate the airflow from the flue 162 into two separate airflows that are in communication with the canopy 26, as described in detail below.

With continued reference to FIG. 15, the refrigeration system 182 includes an evaporator 190 disposed in the second air passageway 180 of the case 14 above the flue 162 to refrigerate the airflow 186. The fan 140 is disposed in the base 18 and supported by the housing 146 and generates the airflows 186, 188 through the base 18, through the evaporator 190 along the passageways 178, 180, and through the canopy 26. The refrigerated and non-refrigerated airflows 186, 188 are discharged through respective outlets 194, 198 in the form of first and second air curtains. As will be appreciated by one of ordinary skill in the art, the refrigeration system 182 also includes a compressor (not shown), a condenser (not shown), and other components to define a refrigeration circuit for conditioning the airflow passing through the evaporator 190.

As is known in the art, the evaporator 190 receives a saturated refrigerant that has passed through an expansion valve from the condenser. The saturated refrigerant is evaporated as it passes through the evaporator 190 as a result of absorbing heat from air passing over the evaporator 190. The absorption of heat by the refrigerant allows the temperature of the air to decrease as it passes over the evaporator 190. The heated or gaseous refrigerant then exits the evaporator 190 and is pumped back to the compressor for re-processing into the refrigeration system 182. The cooled airflow 186 exiting the evaporator 190 via heat exchange with the liquid refrigerant is directed up through the first air passageway 178 and is introduced into the product display area 30 as an air curtain that maintains the food product at desired conditions. The refrigerated airflow 186 is directed downward through the product display area 30 from the air outlet 194 in canopy 26 toward the base 18, where at least a portion of the airflow 186 hits the deflector 138 and is redirected down through an inlet (not shown) back into the flue 162.

The base 18 is a continuous, one-piece structure that eliminates seams/gaps and reduces the potential for leaks that may result from condensation during the defrost cycle or from a cleaning process of the merchandiser 10 during which the merchandiser 10 is sprayed with water.

Overall, the uni-body merchandiser 10 is built to maintain a refrigerated environment within the product display area 30 for displaying food product and provides a lightweight, seamless, and structurally strong unit. With the uni-body structure described above, the merchandiser 10 retains the same general overall footprint of an existing merchandiser and withstands at least the same structural loads commonly handled by heavy gauge, external structural steel frames at a lesser weight. In particular, it has been found that because many of the structural components are located inside the load-bearing foam insulation in the merchandiser 10, the overall stiffness of the case 14 is increased by approximately two times (i.e. twice as stiff/strong) as an existing merchandiser that includes structural members external to foam insulation.

Because the merchandiser 10 is formed with a uni-body construction, the merchandiser 10 includes fewer seams and gaps as compared to a typical merchandiser and can be more easily maneuvered into place. Fewer seams and gaps (i.e. a tighter overall fit between adjacent merchandisers or merchandiser sections) reduces the likelihood of food product clogging the gaps, which can reduce the time and effort needed to clean the merchandiser 10. If desired, the case 14 of merchandiser 10 can quickly and easily be joined with another case 14*a* (or another merchandiser section), and the cases 14, 14*a* can be sealed from the ambient environment due to the tight-fitting nature of the merchandisers described herein.

Figure 17:
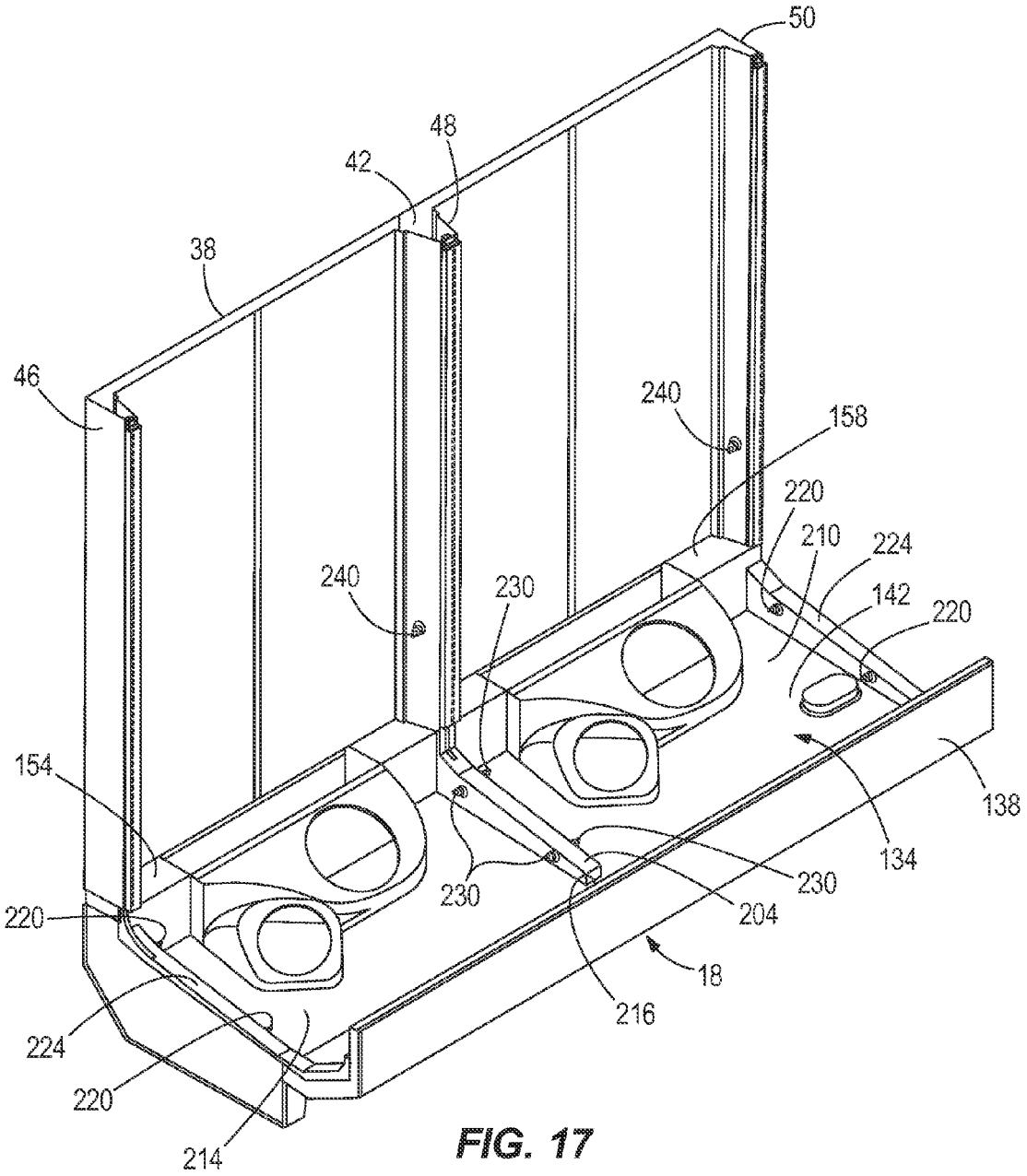
FIG. 17 is a front perspective view of the rear wall and the base component of the merchandiser of FIG. 1, further illustrating a plurality of integrated spray nozzles.

Referring to FIG. 17, a central ridge 204 partly extends from the rib 48 to the rail 138, forming partitioned bays 210, 214 within the base 18 linked by a channel 216 permitting fluid flow therebetween. A common drain may be disposed in one of the bays 210, 214 to serve the entirety of the interior floor 142 across both bays, or each bay 210, 214 may include a separate drain commonly connected (not shown). The bays 210, 214 each include one or more spray nozzles 220 mounted within a respective outer ridge 224 and one or more spray nozzles 230 mounted within the central ridge 204 separating the bays 210, 214. The nozzles 220, 230 are oriented with each respective bay 210, 214 to direct a spray jet of fluid inward, as shown in FIG. 17. An additional nozzle or nozzles 240 are mounted within the ribs 46, 48, 50 to direct a spray jet of fluid within the second air passageway 180, i.e., the area defined by the first wall panel 170 and the second wall panel 174 between the respective ribs 46, 48 and 48, 50 (see FIGS. 15-16). The nozzles 220, 230 are positioned adjacent the interior floor 142. The nozzles 240 are fixed at a vertical height above the raised ledge portions 154, 158 such that fluid is sprayed downward upon the cooling coils of the evaporator 190. In some applications, additional spray nozzles (not shown can also be positioned within the front rail 138 adjacent the interior floor 142.

Figure 18A:
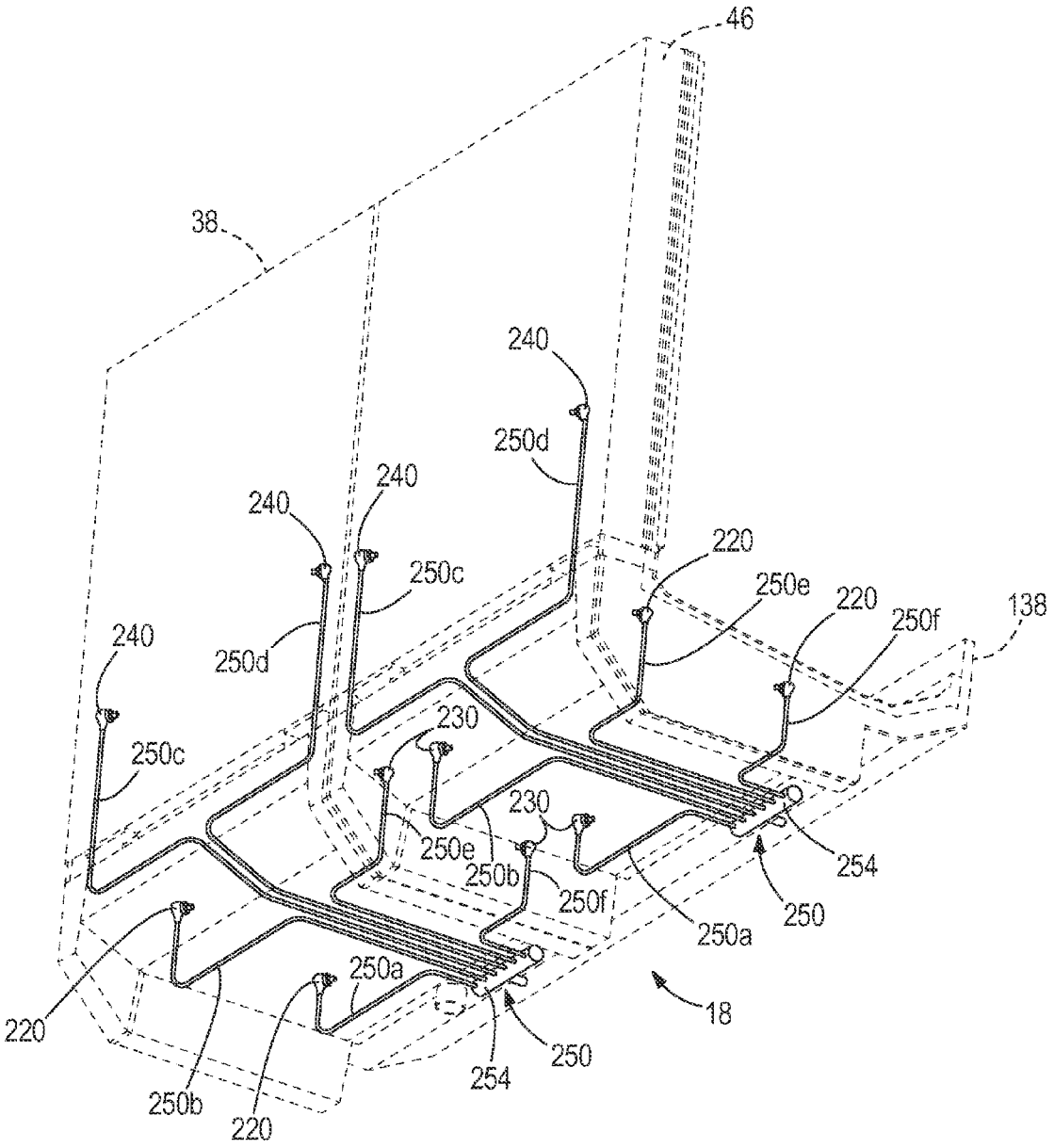
FIG. 18*a* is a back perspective of the rear wall and the base component of the merchandiser of FIG. 1, further illustrating a network of tubes leading to a plurality of integrated spray nozzles.
Figure 18B:
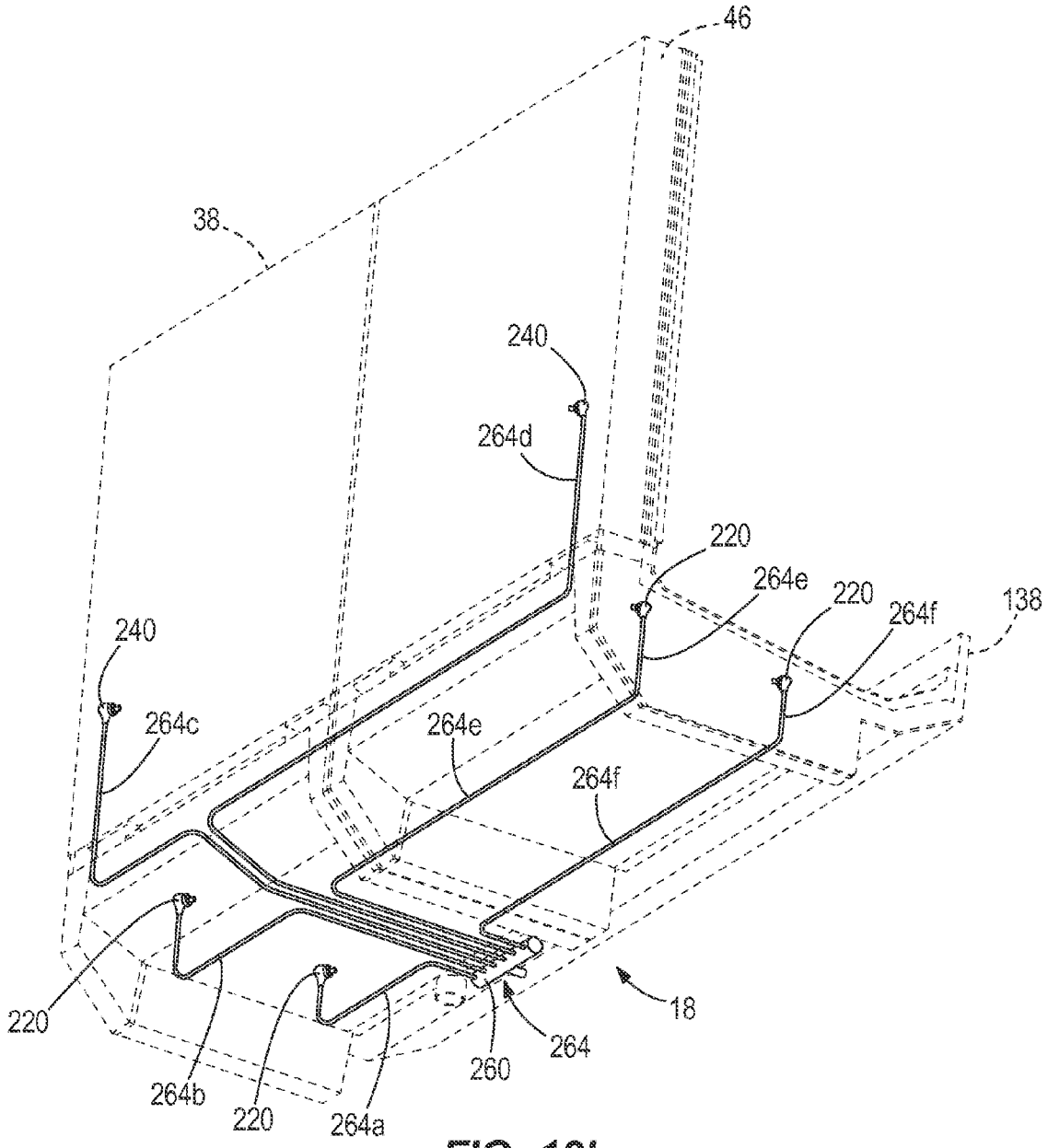
FIG. 18*b* is a back perspective of the rear wall and the base component of the merchandiser of FIG. 1, further illustrating another network of tubes leading to a plurality of integrated spray nozzles.

Referring to FIG. 18*a*, a network of tubes 250 associated with each bay 210, 214 extends from a manifold 254 in fluid communication with a source of water and/or cleaning fluid, as will be further detailed. The manifold 254 may be located in a recessed area or raceway at a front exterior side of the merchandiser 10. Alternatively, the manifold 254 can be foamed in place within the foam insulation 44 encapsulated by the base component 134. The individual tubes 250*a*, 250*b*, 250*c*, 250*d*, 250*e*, and 250*f* of each network 250 are preferably formed of plastic, for example polyethylene, and are foamed in place, i.e., disposed entirely within the foam insulation 44 encapsulated by the base component 134. The tubes 250*a-f* accordingly present no surface irregularities upon or within the floor 142 and are thus unseen by consumers. The portions of the tubes 250*c*, 250*d* associated with the nozzles 240 and extending within the ribs 46, 48, 50 are foamed in place within the foam 44 of the channel 42. The precise routing of the tubes 250*a-f* within the foam 44 is not limiting and each tube may be routed directly to each respective spray nozzle 220, 230, 240 or include bends in selected portions, as illustrated in FIG. 18*a*. Referring to FIG. 18*b*, in some applications a common manifold 260 and tube network 264 serves both bays 210, 214, with individual tubes 264*a-f* extending in a manner previously described within the foam 44 to nozzles 220, 240. Though nozzles 230 and their associated tubing are not specifically illustrated in FIG. 18*b*, FIGS. 18*a* and 18*b* are not limiting and alternative nozzle configurations and combinations are contemplated and within the scope of the invention.

Figure 19:
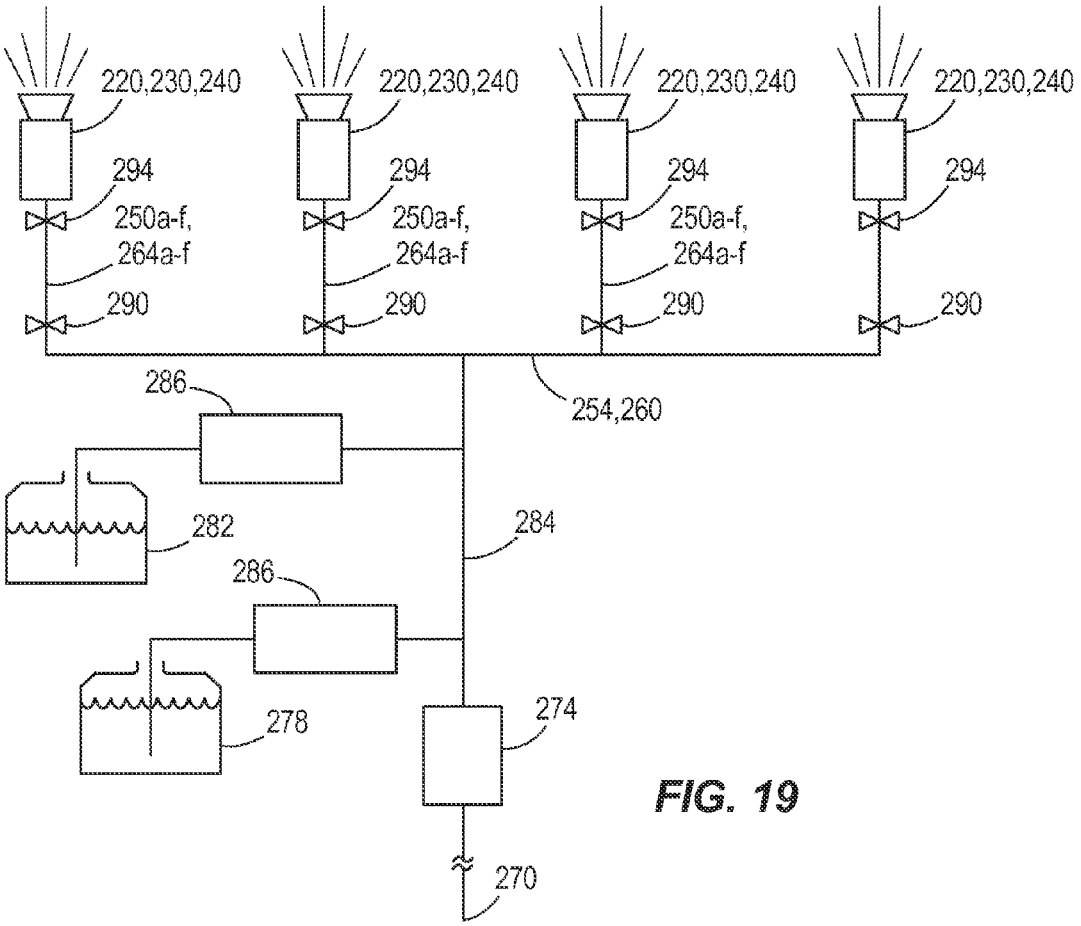
FIG. 19 is a schematic of a fluid cleaning system for the merchandiser of FIG. 1.

Referring also to FIG. 19, the manifold 254, 260 is in fluid communication with a common supply 270 of water, e.g., municipal water, and isolated therefrom with conventional fluid circuit components commonly known to those of ordinary skill. A control valve 274, such as a solenoid operated pilot valve, is operable to permit the flow of water to the manifold 254, 260. One or more containers 278, 282 or reservoirs of agent(s), for example cleaning, rinsing, and sanitizing or other anti-microbial agents, are also fluidly coupled to tubing or piping 284 between the water supply 270 and the manifold 254, 260 and isolated therefrom with valves 286 manually or automatically actuated. The reservoirs 278, 282 may be positioned remotely or locally to the merchandiser 10, for example, in the aforementioned recessed area or raceway in some applications, additional valves 290, 294 are provided for each nozzle/tube set for nozzle isolation. For example, a separate isolation valve can be placed in-line with any of tubes 250*a-f*, 264*a-f* adjacent to either their respective connection to the manifold 254, 260 (valves 290), or adjacent to the individual nozzles 220, 230, 240 (valves 294).

In the course of normal operation of the merchandiser 10, the bottom area of the base 18, particularly the liner 142, can collect food particles and fluids that fall from product being merchandised. In operation, to remove such particles and sanitize the area around the liner 142, upon opening the valve 274, water flows within the piping 284 toward the manifold 254, 260. The piping 284 is configured such that the water flowing within creates a venturi effect at each reservoir 278, 282. Depending on which valves 286 are open, agent is siphoned from the respective reservoir 278, 282 and into the piping 284. In some applications or cleaning cycles, no agent is mixed with the water. The resultant mixed solution (or water) flows to the manifold. 254, 260 and is distributed to each tube 250*a-f*, 264*a-f* (references within FIG. 19 indicate any of tubes 250*a-f* or of tubes 264*a-f* between respective valves 290, 294). The nozzles 220, 230 dispense the mixed solution or water directly onto the liner 142 with a spray distribution and velocity determined by the precise nozzle design and system pressure. The nozzles 240 dispense the mixed solution or water onto the evaporator coils to clean and/or rinse the evaporator 190.

Separate and distinct cleaning cycles with different chemical solutions and agents can be implemented for the nozzles 220, 230 and for the nozzles 240. As an example, a cleaning cycle tailored for food particles or other debris collected on the liner 142 may not be suitable for cleaning or rinsing dust from the evaporator 190. Specific cycles can therefore be effected as desired with proper actuation of the valves 286, 290, 294, to include hot and cold rinse cycles, soaking cycles, hot and cold wash cycles, sanitizing cycles, etc., each using combinations of the aforementioned agents, or of additional agents storable within additional reservoirs. Such cycles can be either manually initiated, such as with a push-button, or automatically initiated via a controller and timer.

Various features and advantages of the invention are set forth in the following claims.

The invention claimed is:

1. A merchandiser comprising:

a base;

a rear wall component extending above the base, wherein the rear wall component includes a protruding rib, and wherein foam insulation material is disposed in the protruding rib, the rear wall component having a first wall panel;

a second wall panel spaced from the first wall panel, the first and second wall panel cooperatively defining an air passageway configured for containing an evaporator, wherein the base and second wall panel at least partially define a product display area;

a spray nozzle disposed within the air passageway and configured to spray fluid onto the evaporator; and a portion of tubing fluidly coupling the spray nozzle to a supply of water, wherein the portion of tubing is disposed within the foam insulation material.

2. The merchandiser of claim 1, wherein the protruding rib is a first protruding rib, and wherein the rear wall component further includes a second protruding rib, the second wall panel extending between the first and second protruding ribs to further define the air passageway, and wherein a second spray nozzle is disposed within the air passageway and configured to spray fluid onto the evaporator, and further including a second portion of tubing fluidly coupling the second spray nozzle to the supply of water, wherein the second portion of tubing is disposed within foam insulation material within the second protruding rib.

3. The merchandiser of claim 1, wherein the merchandiser includes a first side and a second side, the base including a liner extending from the first side to the second side and having a drain, and wherein a second spray nozzle is disposed adjacent the liner and the first side and configured to direct a spray of fluid to the drain.

4. The merchandiser of claim 3, further including a second portion of tubing fluidly coupling the second spray nozzle to the supply of water, wherein the second portion of tubing is disposed within foam insulation material coupled to the base.

5. The merchandiser of claim 4, wherein the foam insulation material coupled to the base is adjacent the liner.

6. The merchandiser of claim 4, wherein the portion of tubing is a first portion of tubing, and wherein the first portion of tubing and the second portion of tubing are connected to a manifold.

7. The merchandiser of claim 1, wherein the portion of tubing is entirely encased within the foam insulation material.

8. The merchandiser of claim 3, further including a third spray nozzle disposed adjacent the base and the second side and configured to direct a spray of fluid to the drain.

9. The merchandiser of claim 1, wherein the base is a single piece element.

10. The merchandiser of claim 1, wherein the air passageway is a first air passageway, and further including a third wall panel spaced from the first wall panel to define a second airflow passageway adjacent the first airflow passageway.

11. A merchandiser having a first side and a second side, and a base, the base comprising:

a drain;

a liner extending from the first side to the second side;

a first spray nozzle disposed adjacent the liner and the first side and configured to direct a spray of fluid to the drain;

a first portion of tubing fluidly coupling the spray nozzle to a supply of water, wherein the first portion of tubing is disposed within foam insulation material coupled to the base;

a rear wall component extending above the base, wherein the rear wall component includes a protruding rib, and wherein foam insulation material is disposed in the protruding rib, the rear wall component having a first wall panel;

a second wall panel spaced from the first wall panel, the first and second wall panel cooperatively defining an air passageway configured for containing an evaporator, wherein the base and second wall panel at least partially define a product display area;

a second spray nozzle disposed within the air passageway and configured to spray fluid onto the evaporator; and a second portion of tubing fluidly coupling the second spray nozzle to the supply of water, wherein the second portion of tubing is disposed within the foam insulation material within the protruding rib.

12. The merchandiser of claim 11, wherein the foam insulation material coupled to the base is adjacent the liner.

13. The merchandiser of claim 11, wherein the first portion of tubing is entirely encased within the foam insulation material.

14. The merchandiser of claim 11, wherein the second spray nozzle is disposed adjacent the liner and the second side and is configured to direct a spray of fluid to the drain.

15. The merchandiser of claim 14, wherein the second portion of tubing fluidly couples the second spray nozzle to the supply of water, and wherein the second portion of tubing is further disposed within the foam insulation material coupled to the base.

16. The merchandiser of claim 15, wherein the first portion of tubing and the second portion of tubing are connected to a manifold.

17. The merchandiser of claim 11, wherein the second portion of tubing is disposed within the foam insulation material within the protruding rib and within the foam insulation material coupled to the base.

18. The merchandiser of claim 11, wherein the protruding rib is a first protruding rib, and wherein the rear wall component further includes a second protruding rib, the second wall panel extending between the first and second protruding ribs to further define the air passageway, and wherein a third spray nozzle is disposed within the air passageway and configured to spray fluid onto the evaporator, and further including a third portion of tubing fluidly coupling the third spray nozzle to the supply of water, wherein the second portion of tubing is disposed within foam insulation material within the second protruding rib.

19. A method of manufacturing a merchandiser having a base portion with a layer of insulating foam, the method comprising:

securing a liner to the base portion;

coupling a first spray nozzle to the base portion adjacent the liner;

positioning a first portion of tubing in fluid communication with the first spray nozzle;

foaming in place the first portion of tubing with the insulating foam;

placing foam insulation material in a protruding rib defined by a rear wall component extending above the base portion of the merchandiser, the rear wall component having a first wall panel;

spacing a second wall panel from the first wall panel to cooperatively define an air passageway configured for containing an evaporator, the base portion and the second wall panel at least partially defining a product display area;

coupling a second spray nozzle to the merchandiser within the air passageway to spray fluid onto the evaporator;

positioning a second portion of tubing in fluid communication with the second spray nozzle; and foaming in place the second portion of tubing within the protruding rib with the insulating foam.

* * * * *